US006287089B1

(12) United States Patent
Williams et al.

(10) Patent No.: US 6,287,089 B1
(45) Date of Patent: Sep. 11, 2001

(54) SCROLL COMPRESSOR WITH HEAT SHIELD

(75) Inventors: John R. Williams; Tracy Milliff; Joe T. Hill, all of Bristol; Todd Dewar, Abingdon, all of VA (US); Gene Michael Fields, Arkadelphia, AR (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 09/451,306

(22) Filed: Nov. 29, 1999

(51) Int. Cl.[7] ..... F04B 49/00; F01C 1/02; F01C 21/04

(52) U.S. Cl. ..... 417/310; 418/55.1; 418/55.5; 418/83

(58) Field of Search ..... 417/310; 418/55.1, 418/83, 55.5

(56) References Cited

U.S. PATENT DOCUMENTS 5,487,654 * 1/1996 Wallis et al. ..... 418/55.1
5,649,816 * 7/1997 Wallis et al. ..... 418/55.1
5,674,062 * 10/1997 Weatherston ..... 418/55.1

FOREIGN PATENT DOCUMENTS 57-206786 * 12/1982 (JP) ..... 418/83
8-210273 * 8/1996 (JP) ..... F04C/18/02

* cited by examiner

*Primary Examiner*—Charles G. Freay
*Assistant Examiner*—Michael K. Gray
(74) *Attorney, Agent, or Firm*—Carlson, Gaskey & Olds

(57) ABSTRACT

A scroll compressor includes a non-orbiting scroll wherein the base is sealed to the housing. That is, the non-orbiting scroll provides the function of the scroll member, and also the function typically provided by a separator. A heat shield is positioned between the discharge pressure chamber and the base of the non-orbiting scroll. Leakage paths are provided to allow refrigerant to communicate between the discharge pressure chamber and spaces between the heat shield and the non-orbiting scroll.

22 Claims, 1 Drawing Sheet

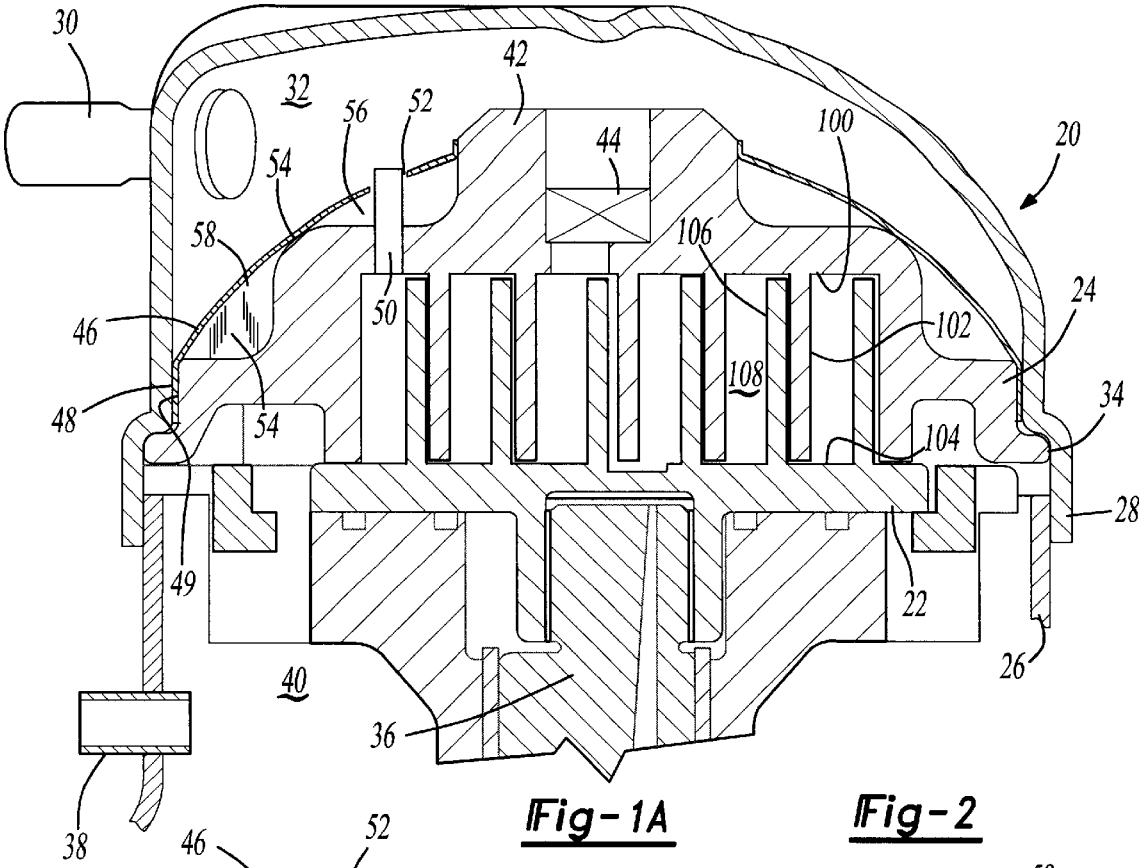
Fig-1A
Fig-2
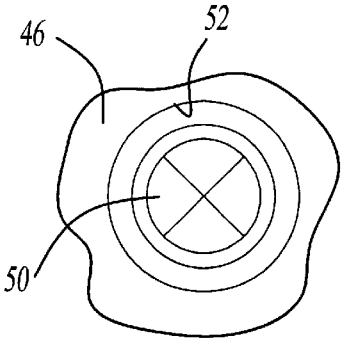
Fig-1B
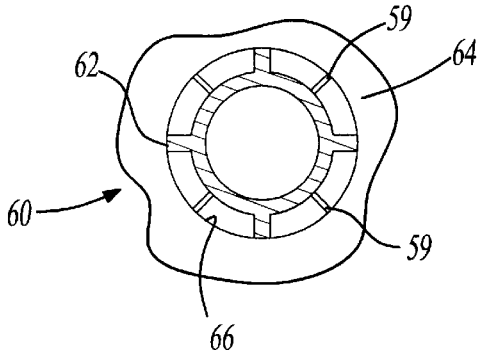
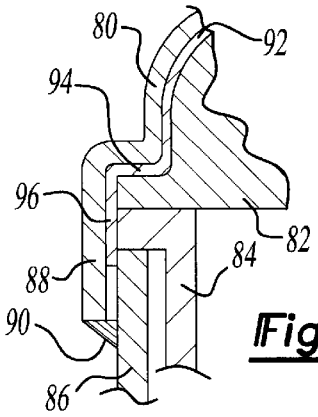
Fig-4
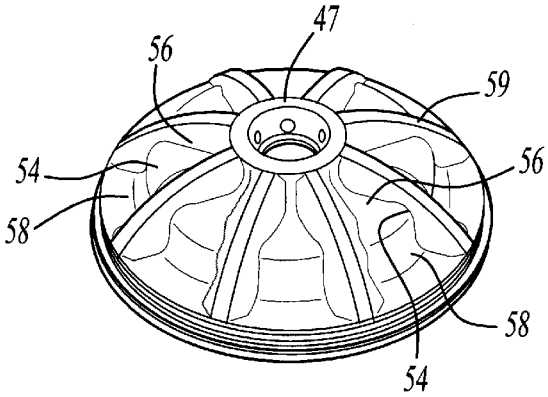
Fig-3

SCROLL COMPRESSOR WITH HEAT SHIELD

BACKGROUND OF INVENTION

This invention relates to a scroll compressor of the sort having the non-orbiting scroll incorporating a separator plate feature, and wherein a heat shield is placed above the base of the non-orbiting scroll to reduce the amount of heat from the discharge pressure gas that reaches the non-orbiting scroll.

Modern refrigerant compressors are often mounted within a sealed container. In these compressors, the pump unit for compressing the refrigerant is positioned at one end, and a motor for driving the pump unit is positioned at another end. Often the suction pressure refrigerant is allowed to circulate over the motor, cooling the motor. In such compressors, it becomes necessary to separate the suction pressure chamber from the discharge pressure chamber. Typically, there is a plate separating the housing into a suction pressure chamber and a discharge pressure chamber.

One popular type of modern compressor is a scroll compressor. A scroll compressor includes a pair of scroll members each having a base and a generally spiral wrap extending from the base. The wraps of the two scroll members interfit to define compression chambers. One of the scroll members is driven to orbit relative to the other, and during this orbital movement, the compression chambers decrease in volume.

In traditional scroll compressors, the non-orbiting scroll does not seal against the compressor housing. Instead, a separate separator plate is positioned typically outwardly of the base of the non-orbiting scroll to separate the housing into the suction and discharge pressure chambers. Most typically, a discharge pressure chamber is formed above the separator plate, and the area below the separator plate is at suction pressure.

More recently, it has been proposed to incorporate the separator function into the base of the non-orbiting scroll. In such compressors, the base of the non-orbiting scroll is sealed to the housing. Thus, there is the discharge pressure chamber on one side of the base of the on-orbiting scroll.

In refrigerant compressors, compressed refrigerant often reaches relatively high temperatures. With the above discussed recent scroll compressor improvements, this hot gas communicates with the rear of the base of the non-orbiting scroll. The scroll base may thus reach undesirably high temperatures thus transferring a significant amount of heat to the suction side of the compressor.

SUMMARY OF THE INVENTION

In a disclosed embodiment of this invention, a scroll compressor has an orbiting scroll member and a non-orbiting scroll member. The non-orbiting scroll is also utilized to separate a housing containing both scroll members into suction and discharge pressure chambers. Preferably, the non-orbiting scroll has an outer peripheral surface which is sealed to an inner peripheral surface of the housing to seal the housing and define the suction and discharge pressure chambers. Other ways of sealing the non-orbiting scroll to the housing may be used. A thin heat shield is provided outwardly of the base of the non-orbiting scroll to minimize heat from the discharge pressure chamber reaching the base of the non-orbiting scroll.

In a preferred embodiment, the heat shield may be a thin metal shield such as steel, or may be formed of a plastic. It is preferred that the heat shield be positioned between the discharge pressure chamber and the seal point between the non-orbiting scroll and the housing.

In another feature, the heat shield is provided with leakage paths such that some discharge pressure refrigerant can leak beyond the heat shield and into chambers between the heat shield and the non-orbiting scroll. The discharge pressure refrigerant in these chambers will reduce any likelihood of vibration or noise due to minute pressure differences across the heat shield.

In one embodiment, a pressure relief valve extends through the base of the non-orbiting scroll, and extends through the heat shield. Preferably, the heat shield opening which receives the valve is larger than the outer periphery of the valve such that there is clearance between the valve and the heat shield opening. This allows assembly of the parts and provides additional passages for pressure-balancing gas to move into the chambers.

Also, the shield could have a through hole. This is the preferred embodiment with the relief valve mounted on the suction side.

In another embodiment, the heat shield surrounds a boss in the base of the non-orbiting scroll which receives the check valve. There is either a clearance, such as the first embodiment, or the boss is formed within an irregular outer surface such that leakage paths are maintained.

The non-orbiting scroll is preferably provided with an outer surface on the base facing the discharge pressure chamber which is convoluted to provide structural strength. In a preferred embodiment, there is a radially outer center rib with indentions both axially below and axially above the central rib. In the present invention, these indentions provide the chambers mentioned above which receive the discharge pressure gas. Further, other ribs extend radially outwardly and are curved to support the inner surface of the heat shield. The indentions extend between these radially extending ribs.

These and other features of the present invention can be best understood from the following specification and drawings.

BRIEF DESCRIPTION OF THE DRAWINGS

FIG. 1A shows a first embodiment scroll compressor.

FIG. 1B is a cross-sectional view of one portion of the FIG. 1A embodiment.

FIG. 2 shows a second embodiment.

FIG. 3 shows the non-orbiting scroll of the present invention.

FIG. 4 shows an alternate embodiment.

DETAILED DESCRIPTION OF PREFERRED EMBODIMENTS

A scroll compressor 20 is illustrated in FIG. 1A. Scroll compressor 20 incorporates an orbiting scroll 22 and a non-orbiting scroll 24. A center shell 26 is secured to an upper shell 28, such as by welding, to form a sealed housing. A discharge pressure tube 30 extends outwardly of the upper shell 28. A discharge pressure chamber 32 is defined within the upper shell 28, and communicating with the tube 30.

The non-orbiting scroll 24 has a base 100 and a spiral wrap 102 as known extending from the base, as known. The non-orbiting scroll 22 similarly has a base 104 and a spiral wrap 106, and compression chambers 108 are defined between the two wraps. However, in the non-orbiting scroll 24, the base is sealed at 34 to the inner periphery of the upper shell 28. The base itself can form a seal, or a separate seal element can be used. A shaft 36 is driven by a motor to drive the orbiting scroll 22. A suction tube 38 extends through the center shell 26 to supply refrigerant to a chamber 40. As can be seen, the suction tube 38 is positioned on a side of the orbiting scroll 22 remote from the non-orbiting scroll 24. The sealing joint between the base of non-orbiting scroll 24 and the upper shell 28 divides the interior of the housing into the discharge pressure chamber 32 and the suction pressure chamber 40.

A boss 42 on the base receives a check valve 44, shown schematically. Refrigerant is compressed between the orbiting and non-orbiting scrolls 22 and 24, and passes through check valve 44 and into chamber 32.

The gas in chamber 32 is relatively hot after having been compressed. Thus, the rear of the base of the non-orbiting scroll 24 could become hot if the gas in chamber 32 were able to communicate freely with the base. Thus, the present invention incorporates a thin heat shield 46 between the chamber 32 and the base of the non-orbiting scroll 24. A downwardly extending cylindrical portion 48 of the heat shield sits freely between an outer peripheral portion 49 of the non-orbiting scroll 34, and an inner peripheral portion of the housing 28. That is, the heat shield can be a loose fit, and need not be secured to either the non-orbiting scroll 24 or the housing 28.

The heat shield 46 is shown receiving a pressure relief valve 50 which extends through the base of the non-orbiting scroll 24, and also through an opening 52 in the heat shield 46.

As can be seen in FIG. 1B, the opening 52 is formed to be larger than the outer periphery of the valve 50. Thus, refrigerant from chamber 32 can communicate into spaces between non-orbiting scroll 24 and heat shield 46, such as spaces 56 and 58. Small leaks can also be designed at inner diameter, outer diameter or other locations. This gas will prevent the heat shield 46 from flexing, vibrating, or otherwise making undesirable noise due to a pressure imbalance. That is, the provision of the discharge pressure gas on both sides of the heat shield 46 will ensure that the heat shield will not be prone to undesirable vibration or noise during operation.

As also shown, a central rib 54 extends around the outer periphery of the base of the non-orbiting scroll 24. Further, a radially extending rib 59 extends and supports the heat shield 54. Again, the heat shield 46 is not secured to the ribs 59, or any other structure of the non-orbiting scroll 24. Alternatively, the two can be connected, such as by screws. Thus, although the ribs 59 do support the heat shield 46 in a preferred embodiment, the refrigerant is able to leak circumferentially around the ribs and into the indentations and chambers or spaces 56 and 58.

A second embodiment 60 is shown in FIG. 2. In second embodiment 60, boss 42 is formed to have outwardly extending projections 62. Heat shield 64 has an opening 66 surrounding the boss, but the spaces between projections 62 allow leakage. Alternatively, the shield could have notches at its inner diameter.

As shown in FIG. 3, the radially extending ribs 59 separate the indentations 56 and 58. The centrally extending rib 54 extends around the periphery of the non-orbiting scroll base. This structure provides functional benefits to provide better stability and structure to the non-orbiting scroll. However, the structure also provides pockets which result in better operation of the heat shield.

FIG. 4 shows a further embodiment wherein the endcap 80 is positioned relative to the non-orbiting scroll 82, and the crankcase 83 as shown. The center shell 86 extends upwardly. A weld joint is formed between a downwardly extending portion 88 of the end cap 80 and a center shell 86 at 90. The heat shield 92 has a portion 94 extending radially outwardly in another portion 96 extending axially downwardly. The portion 94 and 96 prevent ingress of any weld contaminants back upwardly into the compressor shell when the endcap 80 is welded to center shell 86. Further, the seal between the heat shield 92 and the housing could be formed at portion 94 or portion 96. While clearance is shown in FIG. 4, it should be understood that in practice that there would be no such clearance between various components, and that the portion 88 would preferably tightly contact the portion 96.

While several embodiments have been disclosed, it should be understood that variations are possible. As an example, the heat shield could have a seal with a gasket on its outer periphery. The heat shield could be sealed to the minor outer diameter of the fixed scroll, or at the top surface of the fixed scroll, such as by a portion 94. Also, the heat shield could be attached by any of several methods. As an example, the heat shield could be press fit about the check valve boss 42, or press fit at its outer periphery into the endcap. Again, as mentioned, the heat shield could be attached such as by a screw.

The heat shield could also be incorporated above a standard separator plate. Such a heat shield would provide many of the same benefits.

Although a preferred embodiment of this invention has been disclosed, a worker in this art would recognize the modifications would come within the scope of this invention. For that reason, the following claims should be studied to determine a true scope and content of this invention.

What is claimed is:

1. A scroll compressor comprising:

a sealed housing;

a first scroll member having a base and a generally spiral wrap extending from said base, a seal provided between said base and said housing to define a discharge pressure chamber on one side of said base, and a suction pressure chamber on a second side of said base;

a second scroll member having a base and a generally spiral wrap extending from said base, said wraps of said first and second scroll members interfitting to define compression chambers;

a motor for driving said second scroll member to orbit relative to said first scroll member; and a thin heat shield positioned between said base of said first scroll member, and said discharge pressure chamber, and on said discharge pressure side of said base of said first scroll member, a suction tube positioned on an opposed side of said base of said second scroll member from said first scroll member and delivering a refrigerant into said suction chamber.

2. A scroll compressor as recited in claim 1, wherein there is at least one opening in said heat shield to allow gas to flow from said discharge pressure chamber to spaces between said heat shield and said base of said first scroll member.

3. A scroll compressor as recited in claim 2, wherein a pressure relief valve is mounted in said first scroll member base, and extends through an opening in said heat shield, said opening being larger than an outer periphery of said pressure relief valve, such that refrigerant in said discharge pressure chamber can leak through said opening and into said spaces.

4. A scroll compressor as recited in 2, wherein said base has a central discharge port for supplying refrigerant from compression chambers defined between said wraps into said discharge pressure chamber, said central discharge port defining a boss with an outer periphery, and there being passages between said heat shield and said outer periphery of said boss to allow refrigerant to leak from said discharge pressure chamber into said spaces.

5. A scroll compressor as recited in claim 2, wherein said spaces are defined by indentations on an outer surface of said base of said first scroll member.

6. A scroll compressor as recited in claim 5, wherein said first scroll member base has a generally circumferentially extending central rib, and indentations spaced both above and below said central rib to define said spaces.

7. A scroll compressor as recited in claim 6, wherein radially extending ribs extend between said indentations.

8. A scroll compressor as recited in claim 7, wherein said radially extending ribs underlie and support said heat shield.

9. A scroll compressor as recited in claim 1, wherein said heat shield is formed of a metal.

10. A scroll compressor as recited in claim 1, wherein said heat shield is formed of a plastic.

11. A scroll compressor as recited in claim 1, wherein said sealed housing includes a center shell and an endcap, said endcap extending radially outwardly and axially along a portion of said center shell, and said heat shield having a portion extending axially along with said axially extending portion of said endcap, said axially extending portion of said heatshield preventing ingress of weld splatter during the welding of said endcap to said center shell.

12. A scroll compressor comprising:

a sealed housing, and including a suction tube for delivering a refrigerant into a suction pressure chamber and a discharge tube for delivering compressed refrigerant from a discharge pressure chamber;

a first scroll member having a base and a generally spiral wrap extending from said base, said first scroll member being positioned to separate said suction pressure chamber from said discharge pressure chamber;

a second scroll member having a base and a generally spiral wrap extending from said base, said wraps of said first and second scroll members interfitting to define compression chambers;

a motor for driving said second scroll member to orbit relative to said first scroll member;

a thin heat shield positioned between said base of said first scroll member, and said discharge pressure chamber; and there being at least one opening to allow refrigerant to pass from said discharge pressure chamber into spaces defined between said heat shield and said base of said first scroll member.

13. A scroll compressor as recited in claim 12, wherein there are openings in said heat shield to allow gas to flow from said discharge pressure chamber to spaces between said heat shield and said base of said first scroll member.

14. A scroll compressor as recited in claim 13, wherein a pressure relief valve is mounted in said first scroll member base, and extends through an opening in said heat shield, said opening being larger than an outer periphery of said pressure relief valve, such that refrigerant in said discharge pressure chamber can leak through said opening and into said spaces.

15. A scroll compressor as recited in 13, wherein said base has a central discharge port for supplying refrigerant from compression chambers defined between said wraps into said discharge pressure chamber, said central discharge port defining a boss with an outer periphery.

16. A scroll compressor as recited in claim 15, wherein passages are formed between said heat shield and said outer periphery of said boss to allow refrigerant to leak from said discharge pressure chamber into said spaces.

17. A scroll compressor as recited in claim 13, wherein said spaces are defined by indentations on an outer surface of said base of said first scroll member.

18. A scroll compressor as recited in claim 17, wherein said first scroll member base has a generally circumferentially extending central rib, and indentations spaced both above and below said central rib to define said spaces.

19. A scroll compressor as recited in claim 18, wherein radially extending ribs extend between said indentations.

20. A scroll compressor as recited in claim 19, wherein said radially extending ribs underlie and support said heat shield.

21. A scroll compressor as recited in claim 12, wherein said sealed housing includes a center shell and an endcap, said endcap extending radially outwardly and axially along a portion of said center shell, and said heat shield having a portion extending axially along with said axially extending portion of said endcap, said axially extending portion of said heatshield preventing ingress of weld splatter during the welding of said endcap to said center shell.

22. A scroll compressor as recited in claim 12, wherein said spaces are defined between said heat shield and a base of said first scroll member.

* * * * *